US007108553B2

(12) United States Patent
Zhu et al.

(10) Patent No.: US 7,108,553 B2
(45) Date of Patent: Sep. 19, 2006

(54) MEMORY CARD CONNECTOR

(75) Inventors: ZiQiang Zhu, Kunsan (CN); Guohua Zhang, Kunsan (CN); Kechang Wei, Kunsan (CN)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 10/940,348

(22) Filed: Sep. 13, 2004

(65) Prior Publication Data

US 2005/0059299 A1 Mar. 17, 2005

(30) Foreign Application Priority Data

Sep. 12, 2003 (TW) ..... 92216481 U

(51) Int. Cl.
*H01R 13/648* (2006.01)

(52) U.S. Cl. ..... 439/607

(58) Field of Classification Search ..... 439/607–609, 439/638, 159, 630; 361/818, 685; 174/35 R
See application file for complete search history.

(56) References Cited

U.S. PATENT DOCUMENTS

| | | | | |
|---|---|---|---|---|
| 5,339,222 | A * | 8/1994 | Simmons et al. | 361/818 |
| 5,726,867 | A * | 3/1998 | Zarreii | 361/818 |
| RE36,968 | E * | 11/2000 | Shieh | 361/685 |
| 6,264,506 | B1 * | 7/2001 | Yasufuku et al. | 439/638 |
| 6,302,715 | B1 * | 10/2001 | Sato et al. | 439/159 |
| 6,524,137 | B1 | 2/2003 | Liu et al. | |

* cited by examiner

*Primary Examiner*—Alexander Gilman
(74) *Attorney, Agent, or Firm*—Wei Te Chung

(57) ABSTRACT

A memory card connector (100) includes an insulative housing (1), a housing shield (2) enclosing the housing and a circuit module (3) with a plurality of conductive terminals. The insulative housing includes a generally U-shape body portion (10). The insulative housing has a first and second locking barbs (120, 122) in a side thereof. The housing shield is composed of an upper and a lower cover plates (20, 21). The lower cover plate forms an upwardly bent first latch portion (24) for engaging with the first locking barb of the housing. The upper cover plate forms a downwardly bent second latch portion (25) for latching the second locking barb of the housing, thereby securely holding the housing in the shield.

3 Claims, 5 Drawing Sheets

MEMORY CARD CONNECTOR

BACKGROUND OF THE INVENTION

1. Field of the Invention

The present invention relates to an electrical connector and more particularly, to a memory card connector.

2. Description of the Prior Art

Electrical cards are widely used in electrical devices for storing information. Generally, card connectors are used for interconnecting the electrical cards with the electrical devices. A related conventional card connector is disclosed in U.S. Pat. No. 6,524,137 B1. The conventional card connector includes an insulative housing and a shield. The shield comprises upper and lower cover plates shielding the insulative housing. The cover plates each perpendicularly form a pair of locking tabs on two ends thereof. The housing defines a plurality of receiving slits for receiving the locking tabs, thereby retaining the cover plates thereon. However, due to the cover plates interlock with housing only through engagement of the locking barbs and the receiving slits, therefore, the cover plates may break away from the housing under extrusion. In addition, locking tabs are very tiny and are easily fractured during inserting into the slits, thereby decreasing locking function of the whole cover plates.

Hence, an improved electrical connector incorporating electrical connectors of different types and providing good signal transmitting quality is desired to overcome the foregoing shortcomings.

BRIEF SUMMARY OF THE INVENTION

A main object of the present invention is to provide a memory card connector having a shield securely and conveniently holding the insulative housing therein.

To attain the above object, a memory card connector according to the present invention includes an insulative housing, a housing shield enclosing the housing and a circuit module with a plurality of conductive terminals. The insulative housing includes a generally U-shape body portion. The insulative housing has a first and second locking barbs in a side thereof. The housing shield is composed of an upper and a lower cover plates. The lower cover plate forms an upwardly bent first latch portion for engaging with the first locking barb of the housing. The upper cover plate forms a downwardly bent second latch portion for latching the second locking barb of the housing, thereby securely holding the housing in the shield.

Other objects, advantages and novel features of the invention will become more apparent from the following detailed description when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
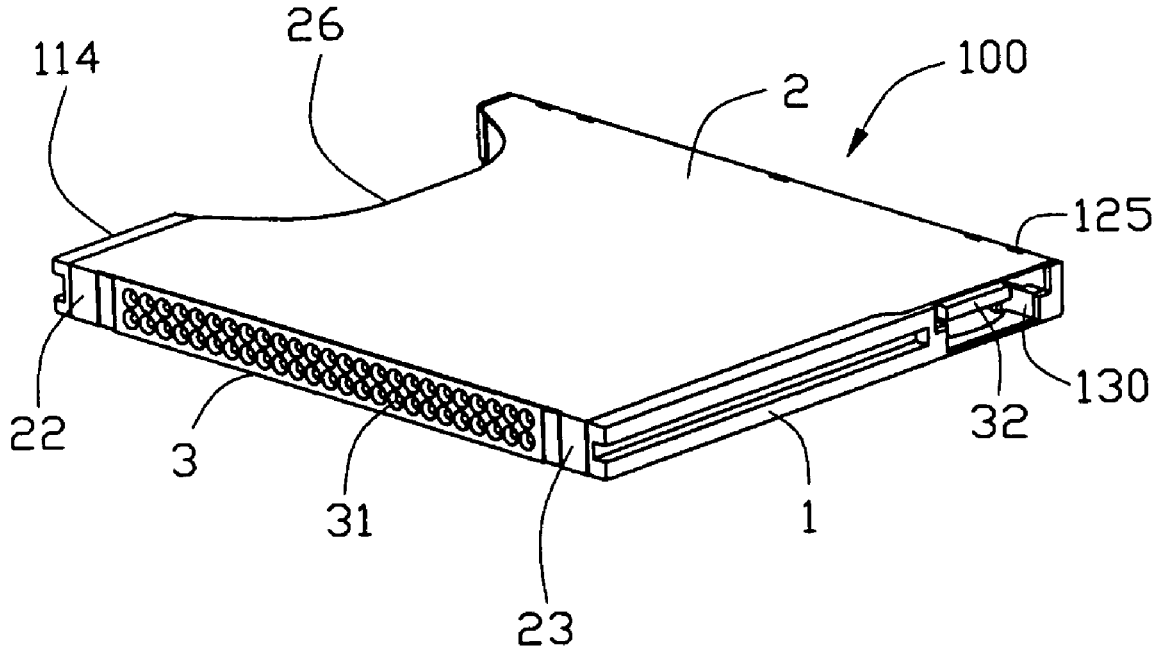
FIG. 1 is a perspective view of a memory card connector according to the present invention.
Figure 2:
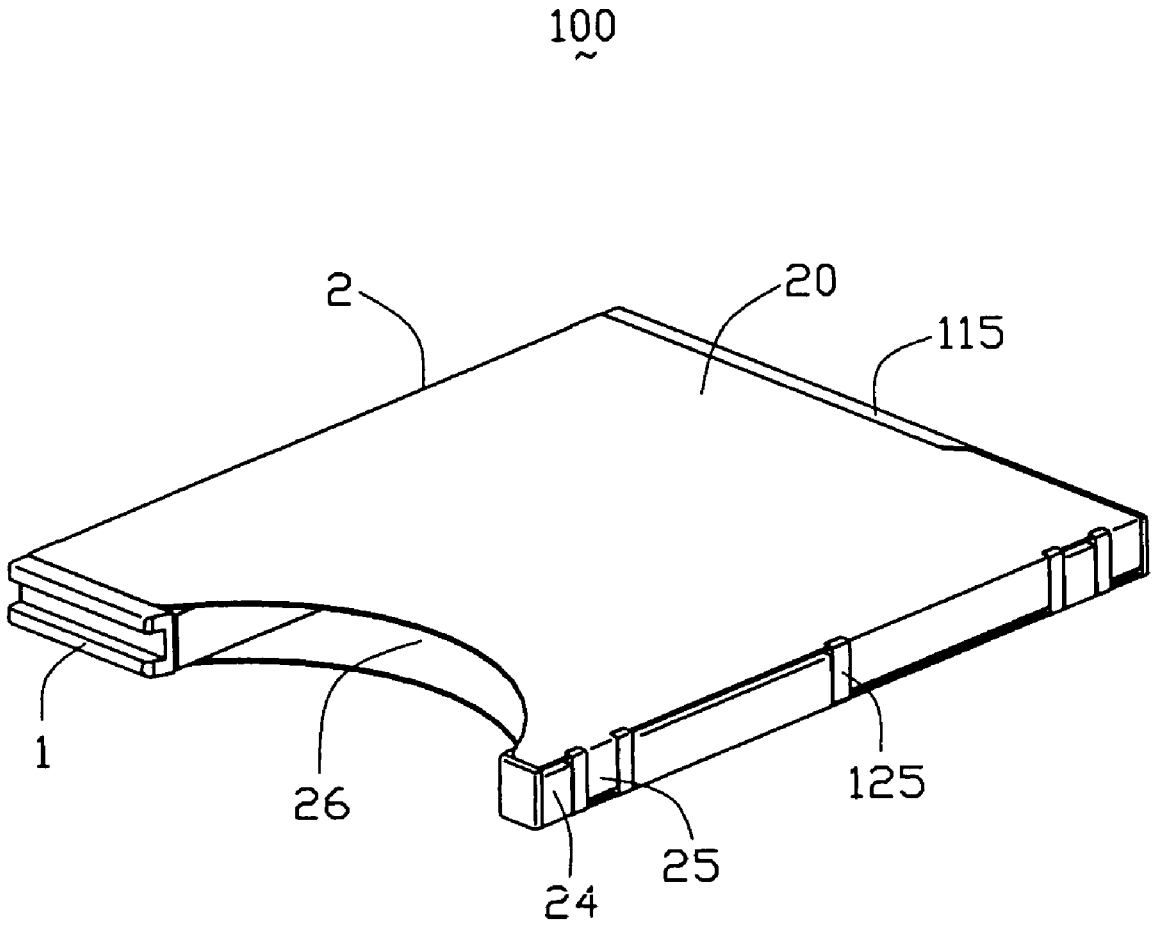
FIG. 2 is another perspective view of FIG. 1.

Referring to FIGS. 1–2, a memory card connector according to the present invention includes an insulative housing 1, a housing shield 2 and a circuit module 3 mounted on the housing 1.

Figure 3:
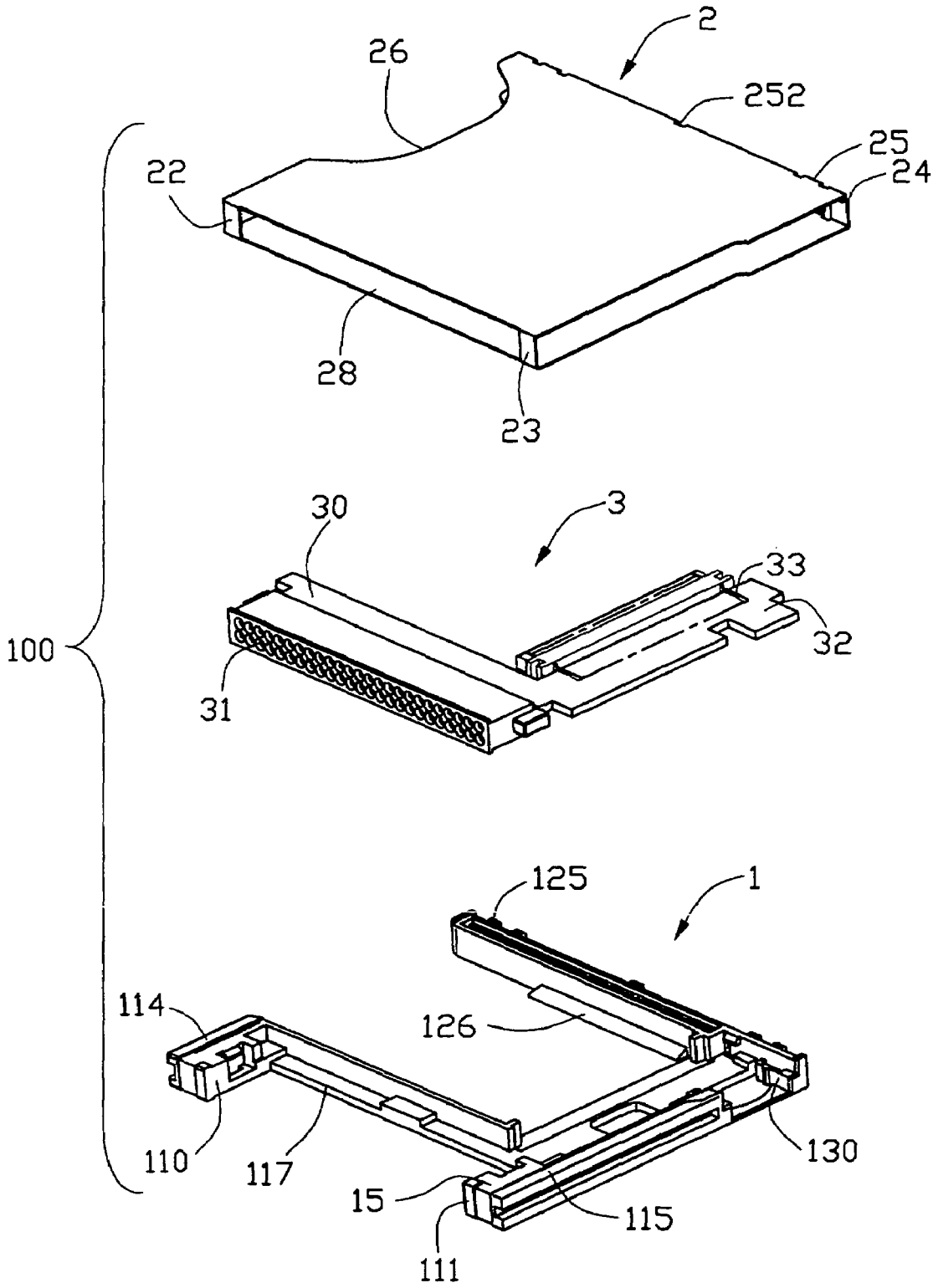
FIG. 3 is an exploded view of FIG. 1.
Figure 4:
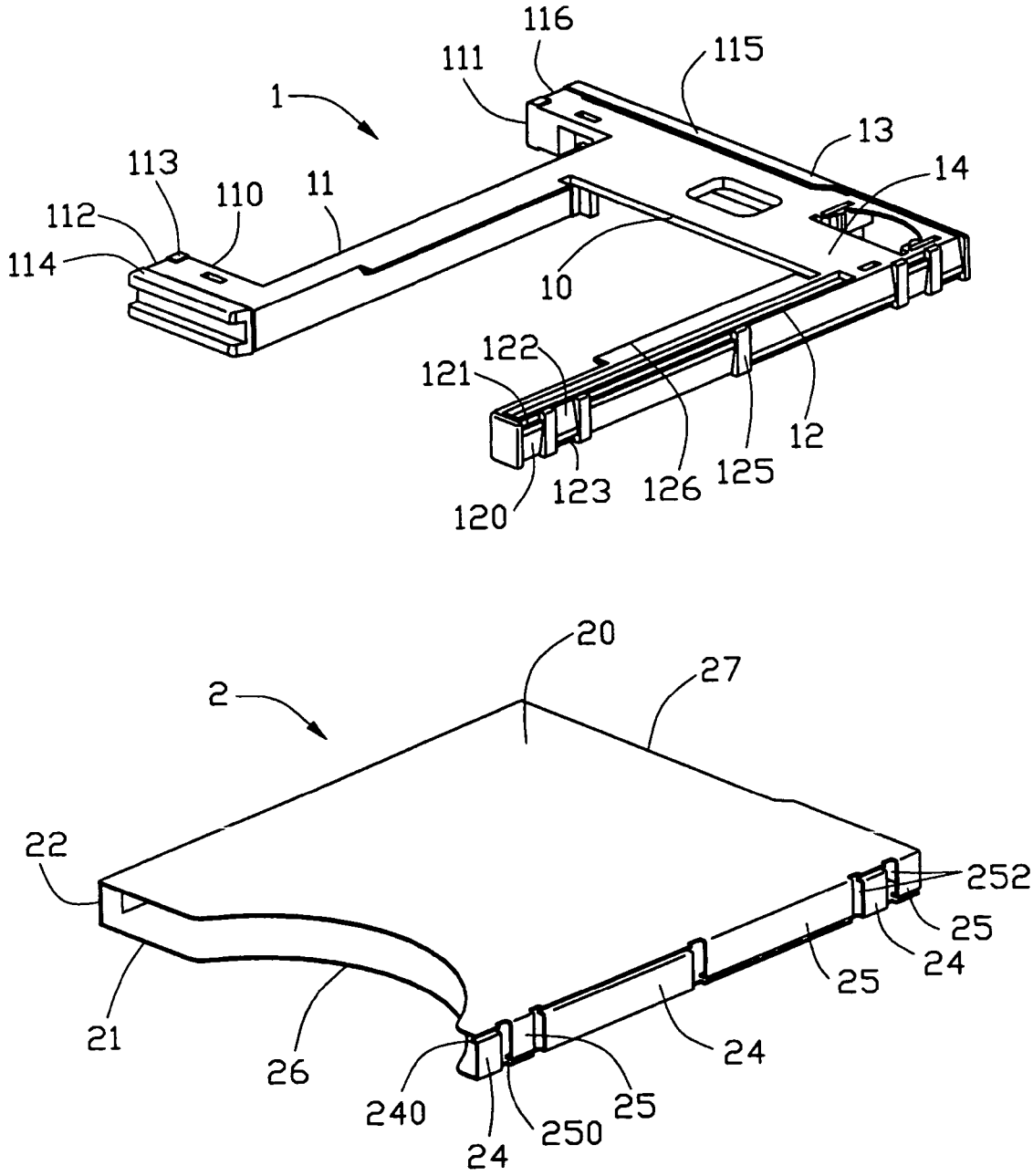
FIG. 4 is partially exploded view of FIG. 1.
Figure 5:
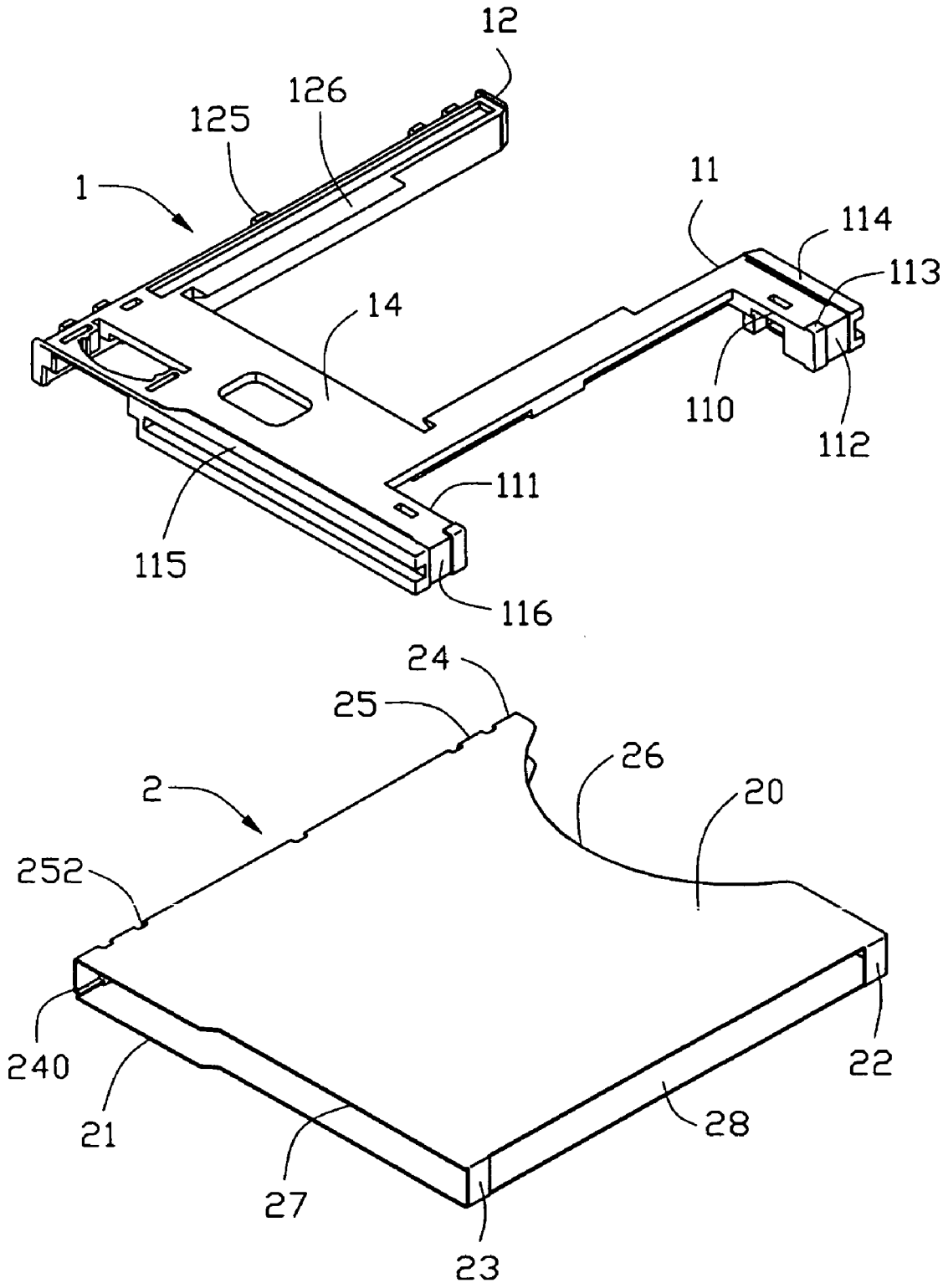
FIG. 5 is another partially exploded view of FIG. 1.

Referring to FIGS. 3–5, the housing 1 includes a generally U-shaped body portion 10, the body portion 10 comprises a top surface 14 and a bottom surface 15 and is composed of left and right side beams 11, 12 and a cross beam 13 extending between the side beams 11, 12 to link rear ends of left and right side beams 11, 12. The left side beam 11 comprises a pair of extending arms 110 and 111 leftward extending from front and rear ends thereof, respectively. The cross beam 13 defines a through recess 130 in the bottom surface 15 thereof. The side beams 11, 12 respectively have an engaging piece 126 inwardly projecting from a generally middle portion of a top surface thereof for restricting movements of an inserted card in top-and-bottom directions. The left side beam 11 longitudinally defines a cut-away step portion 117 through an outer side surface and a lower surface thereof. The right side beam 12 comprises a plurality of pairs of first and second wedge-shaped locking barbs 120, 122 alternately projecting from an outside thereof. The first locking barb 120 comprises an upper portion and a lower portion, the upper portion is wider than the lower portion, thereby forming an upper hook portion 121 toward the top surface of the right side beam 12. The second locking barb 122 comprises an upper portion and a lower portion, the upper portion is narrower than the lower portion, thereby forming a lower hook portion 123 toward a bottom surface of the right side beam 12. A generally rectangular locking block 125 positions between each pair of the first and second locking barbs 120, 122. The extending beams 110, 111 respectively define grooves 112, 116 in left ends thereof. A plurality of elongate retaining blocks 114, 115 project from the top and bottom surfaces 14 and 15 of the insulative housing 1, thereby forming a recessed engaging surface (not labeled) in the top and bottom surfaces 14 and 15 of the housing 1. The retaining blocks 114 project outwardly along front side of top and bottom surfaces of the extending arm 110. The retaining blocks 115 projects outwardly along rear sides of cross beam 13 and the extending arm 111.

The housing shield 2 is generally of flat square cassette and comprises an upper cover plate 20 and a lower cover plate 21 for receiving an insulative housing 1 therebetween. A recessed arciform cut-out 26 is defined in a front edge of each cover plate 20, 21 for facilitating inserting or extracting a card. The shield 2 further includes a rear edge 27 thereof for engaging with the retaining block 115 of the housing 1. A pair of connecting tabs 22, 23 integrally connect left sides of the cover plates 20, 21. An opening 28 is defined by the connecting tabs 22, 23 and left sides of the cover plates 20, 21. The lower cover plate 21 comprises a plurality of intermittent first latch portions 24. Each first latch portion 24 is upwardly bent from the lower cover plate 21 for engaging the locking barb 120 of the right beam 12 of the housing 1. A first hold portion 240 is inwardly bent from each first latch portion 24 for locking a corresponding upper hook portion 121 of the first locking barb 120.The upper cover plate 20 comprises a plurality of intermittent second latch portions 25. Each second latch portion 25 is downwardly bent from the upper cover plate 20 for engaging the locking barb 122 of the right beam 12 of the housing 1. A second hold portion 250 is inwardly bent from each second latch portion 25 for locking a corresponding lower hook portion 123 of the second locking barb 122. The housing shield defines a plurality of receiving recesses 252 between adjacent latch portions 24, 25 for engaging with corresponding locking blocks 125 of the housing 1.

Referring to FIG. 3, the circuit module 3 comprises a generally L-shaped circuit board 30 and a first mating portion 31 positioned on a left side of the circuit board 30. The circuit board comprises a plurality of conductive terminals 33 received therein for electrically connecting with the memory card. In addition, the circuit module 3 defines a second mating portion 32 positioned in a rear end of the circuit board 30 received in the through recess 130 of the cross beam 13 of the housing 1. The mating portions 31, 32 respectively connect with external circuits (not shown).

Referring to FIGS. 1–5, in assembly, the circuit module 3 is mounted on the bottom surface 15 of the insulative housing 1, with the first mating portion 31 of the circuit module 3 mounted between the extending arms 110, 111 in the cut-away step portion 117 of the housing 1, and with the second mating portion 32 received in the through recess 130 of the cross beam 13 of the housing 1. The housing shield 2 encloses the housing 1, front and rear edges of the shield 2 engage with the retaining blocks 114, 115 of the housing 1 so that the shield 2 securely closes the housing 1. The cut-out 26 of the shield 2 engages with the U-shaped body portion 10 of the housing 1. The engaging pieces 126 of the left and right side beams 11, 12 securely closes with an inter surface of the shield 2 so that forms a receiving room (not labeled) for receiving a memory card. The connecting tabs 22, 23 positioned on one side of the housing shield 2 respectively hook the grooves 112, 116 of the front and rear extending arms 110, 111 of the left side beam 11 of the housing 1. The rear edge 27 of the shield 2 engages with the first mating portion 3 of the circuit board 3. The first and second latch portions 24, 25 of shield 2 respectively locking with the corresponding locking barbs 120, 122 of the right beam 12 of the housing 1. The first and second hold portions 240, 250 respectively hold corresponding hook portions 121, 123 of the right side beam 12 of the housing 1. The locking blocks 125 secure with corresponding receiving recesses 252 of the shield 2, therefore, the housing 1 securely holds the shield 2.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector assembly comprising:

a housing assembly defining a receiving space for receiving an electronic card along a first direction;

a circuit module including a printed circuit board having thereon a first connection port disposed in the housing assembly for mechanically and electrically connected to said electronic card; and a second connection port disposed in the housing assembly and electrically connected to the first connection port; wherein said second connection port is exposed to an exterior, for connecting to a complementary electronic part, in a second direction being in a non-parallel relation with regard to the first direction, wherein said housing assembly including at least one integral insulative housing having opposite side beams defining a card receiving space for receiving said electronic card; wherein said housing assembly further includes at least one metallic housing shield which is an only device covering the card receiving space in a vertical direction perpendicular to a card insertion direction, and wherein said printed circuit board defines essentially an L-shaped configuration so as not to interfere with the card receiving space.

2. An electrical card connector assembly comprising:

a housing assembly defining a receiving space for receiving an electronic card along a first direction;

a circuit module including a printed circuit board having thereon a first connection port disposed in the housing assembly for mechanically and electrically connected to said electronic card; and a second connection port disposed in the housing assembly and electrically connected to the first connection port; wherein said second connection port is exposed to an exterior, for connecting to a complementary electronic part, in a second direction being in a non-parallel relation with regard to the first direction; wherein said housing assembly includes at least one insulative housing defining a card receiving space for receiving said electronic card and a connector receiving space for receiving said second connection port, wherein said printed circuit board defines essentially an L-shaped configuration so as not to interfere with the card receiving space.

3. The electrical card connector assembly as claimed in claim 2, wherein said housing assembly further includes at least one metallic housing shield which is an only device covering the card receiving space in a vertical direction perpendicular to a card insertion direction.

* * * * *